US010687688B2

(12) United States Patent
Henriksen et al.

(10) Patent No.: US 10,687,688 B2
(45) Date of Patent: Jun. 23, 2020

(54) DISHWASHER AND CONVEYING SYSTEM THEREFOR

(71) Applicant: ELECTROLUX APPLIANCES AKTIEBOLAG, Stockholm (SE)

(72) Inventors: Christian Henriksen, Stockholm (SE); Peter Wickström, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 0 days.

(21) Appl. No.: 16/078,350

(22) PCT Filed: Feb. 26, 2016

(86) PCT No.: PCT/EP2016/054139
§ 371 (c)(1),
(2) Date: Aug. 21, 2018

(87) PCT Pub. No.: WO2017/144122
PCT Pub. Date: Aug. 31, 2017

(65) Prior Publication Data
US 2019/0191961 A1 Jun. 27, 2019

(51) Int. Cl.
*A47L 15/50* (2006.01)

(52) U.S. Cl.
CPC ..... *A47L 15/506* (2013.01)

(58) Field of Classification Search
CPC ..... A47L 15/506
See application file for complete search history.

(56) References Cited

U.S. PATENT DOCUMENTS

| | | | |
|---|---|---|---|
| 7,621,605 | B2 | 11/2009 | Bond et al. |
| 2010/0045152 | A1 | 2/2010 | Bond et al. |
| 2012/0074080 | A1 | 3/2012 | Garcia et al. |
| 2015/0305493 | A1 | 10/2015 | Garcia et al. |
| 2016/0309982 | A1 | 10/2016 | Gerstner et al. |

FOREIGN PATENT DOCUMENTS

| | | | |
|---|---|---|---|
| EP | 3 085 294 | A1 | 10/2016 |
| WO | WO 2014/033092 | A1 | 3/2014 |
| WO | WO 2015/185631 | A1 | 12/2015 |

OTHER PUBLICATIONS

International Search Report and Written Opinion for Application No. PCT/EP2016/054139 dated Jul. 5, 2016, 8 pages.
Office Action for European Application No. 16 706 386.6 dated Mar. 12, 2020, 4 pages.

*Primary Examiner* — Jason Y Ko
(74) *Attorney, Agent, or Firm* — Alston & Bird LLP

(57) ABSTRACT

A conveying system for conveying a rack of a dishwasher between a displaced position and a start position along a path as well as a dishwasher including the conveying system are disclosed. In the displaced position, the rack may be displaced with respect to the start position in at least a first direction perpendicular to a main extension plane of the rack. An elevating arrangement may bias the rack towards the displaced position when the rack is located at a portion of the path. A locking arrangement may releasably lock the rack in an intermediate position between the displaced position and the start position when the rack is located at the portion of the path, thereby preventing the rack from being biasedly retracted to the displaced position or preventing the rack from being displaced away from the intermediate position due to weight of articles carried by the rack.

18 Claims, 4 Drawing Sheets

DISHWASHER AND CONVEYING SYSTEM THEREFOR

CROSS-REFERENCE TO RELATED APPLICATIONS

This application is a national stage application filed under 35 U.S.C. § 371 of International Application No. PCT/EP2016/054139 filed Feb. 26, 2016, which application is hereby incorporated by reference herein in its entirety.

TECHNICAL FIELD

Embodiments herein relate to household appliances, such as dishwashers, sub-systems thereof and the like. In particular, a dishwasher and a conveying system for conveying a rack of the dishwasher are disclosed.

BACKGROUND

Household appliances are provided in a wide range of varieties, including dishwashers and the like. For any dishwasher, but maybe in particular for domestic dishwashers, a factor that is appealing to users thereof relate to user-friendliness of the dishwasher.

In order to improve user-friendliness, a known dishwasher has been provided with an elevating rack. Thanks to that it is possible to elevate the rack, a user of the dishwasher may more comfortably load on and off articles to/from the rack. In this context, the user may more comfortably load on and off articles, since the user will not need reach downwards as much as if the rack was not possible to elevate.

Many known systems for elevation of the rack of the dishwasher exist. For example, WO2014/033092 discloses a sliding and pivoting mechanism of a rack of a domestic appliance for extending and raising the rack out of a body of the domestic appliance. The sliding and pivoting mechanism has at least two pivoting arms which are fixed rotatably to at least one of the side walls of the body with a first end parallel to the plane of the side walls, and are arranged spaced apart parallel to each other, wherein a guide rail is fixed pivotably to respective second ends of the pivoting arms parallel to the plane of the side walls in such a manner that the guide rail can be pivoted out of a lower position within the body into a raised, upper position at least partially outside the body, and at least one running rail which is displaceable linearly in the guide rail and to which the rack is fastened, wherein the sliding and pivoting mechanism has a locking mechanism which is arranged on the guide rail and on one of the pivoting arms and is actuable by an activator fixed on the running rail in order to prevent a simultaneous pivoting and sliding movement. Thanks to the activator a predetermined position is defined—any pivoting of the rack not being possible until the predetermined position has been reached. The pivoting of the sliding and pivoting mechanism is thus locked in the raised, upper position and in the lower position, in sliding of the rack is possible, up until the activator actuates the pivoting arms at the predetermined position.

Aforementioned WO2014/033092 further discloses a dishwasher in which the sliding and pivoting mechanism is installed to allow a rack of the dishwasher to be pivoted and slid to facilitate on/off-loading of articles to/from the rack.

Upon access to an interior of the dishwasher in order to execute various maintenance tasks, a user of the dishwasher need to uncomfortably reach down under the pivoted rack. When reaching under the rack, the user may support her/him-self to mitigate the discomfort of reaching down under the rack—by leaning on a door of the dishwasher. The door, e.g. hinges of the door, may break due to weight of the user. The various maintenance tasks include e.g. cleaning of filters and re-filling of dishwasher consumables, such as salt and the like.

A problem is hence how to improve user-friendliness of a dishwasher having an elevateable rack. A related problem is how to enable improved user-friendliness of a dishwasher having an elevateable rack by providing an improved system for conveying a rack of a dishwasher, such as the above mentioned sliding and pivoting mechanism.

SUMMARY

An object may be to improve user-friendliness of dishwashers of the above mentioned kind.

According to an aspect, this object is achieved by a dishwasher comprising a rack, and a below described conveying system for conveying the rack of the dishwasher.

In some embodiments, the dishwasher comprises a further rack, wherein an interior of the dishwasher is accessible via a space between the rack and the further rack when the rack is in the intermediate position. In other examples, the space may be formed between the rack and an upper periphery of an aperture of the dishwasher. In this manner, user-friendliness of the dishwasher is improved thanks to that the user may simply reach down into the interior through the space, when the user performs maintenance, e.g. empties a filter of the dishwasher or adds salt, for known purposes.

Another object may be to enable improved user-friendliness of the dishwashers of the above mentioned kind.

According to another aspect, this object is achieved by a conveying system for conveying a rack of a dishwasher between a displaced position and a start position along a path. The displaced position is defined by that the rack is displaced with respect to the start position in at least a first direction perpendicular to a main extension plane of the rack. The conveying system comprises an elevating arrangement arranged to bias the rack towards the displaced position when the rack is located at a portion of the path. Moreover, the conveying system comprises a locking arrangement arranged to releasably lock the rack in an intermediate position between the displaced position and the start position when the rack is located at the portion of the path. In this manner, the rack is prevented from being biasedly retracted to the displaced position or the rack is prevented from being displaced away from the intermediate position due to weight of articles carried by the rack.

Thanks to that the locking arrangement is arranged to releasably lock the rack in the intermediate position, the rack is temporarily, i.e. as long as the locking arrangement does not release the rack from the intermediate position, held steady without being displaced towards the displaced position or the start position. Thus, enabling improved user-friendliness of the dishwasher as described above.

In some embodiments, the path is at least partly described by a straight line continued by an arc, wherein the rack, when in the displaced position, is located at a first end of the path, wherein the portion of the path includes the first end and the arc, wherein the rack, when in the start position, is located at a second end of the path, wherein a further portion of the path includes the second end and the straight line.

Thanks to the straight line, kitchenware loaded onto the rack avoids collision with an interior roof of the dishwasher, or any existing further rack, typically placed above the rack.

In some embodiments, the locking arrangement comprises a protruding element being displaceable between a first location and a second location, and wherein the elevating arrangement comprises an opening arranged to receive the protruding element, wherein the protruding element and the opening move relatively each other when the rack is conveyed between the displaced position and the start position, wherein the first location is defined by that the protruding element is displaced to be received by the opening when the rack is in the intermediate position, wherein the second location is defined by that the protruding element is displaced to allow the rack to be freely conveyed between the displaced position and the start position.

In this manner, the locking arrangement may be realized efficiently using a small number of parts. An advantage is that the locking arrangement may be robust and not prone to break.

BRIEF DESCRIPTION OF THE DRAWINGS

The various aspects of embodiments disclosed herein, including particular features and advantages thereof, will be readily understood from the following detailed description and the accompanying drawings, in which.

DETAILED DESCRIPTION

Figure 1:
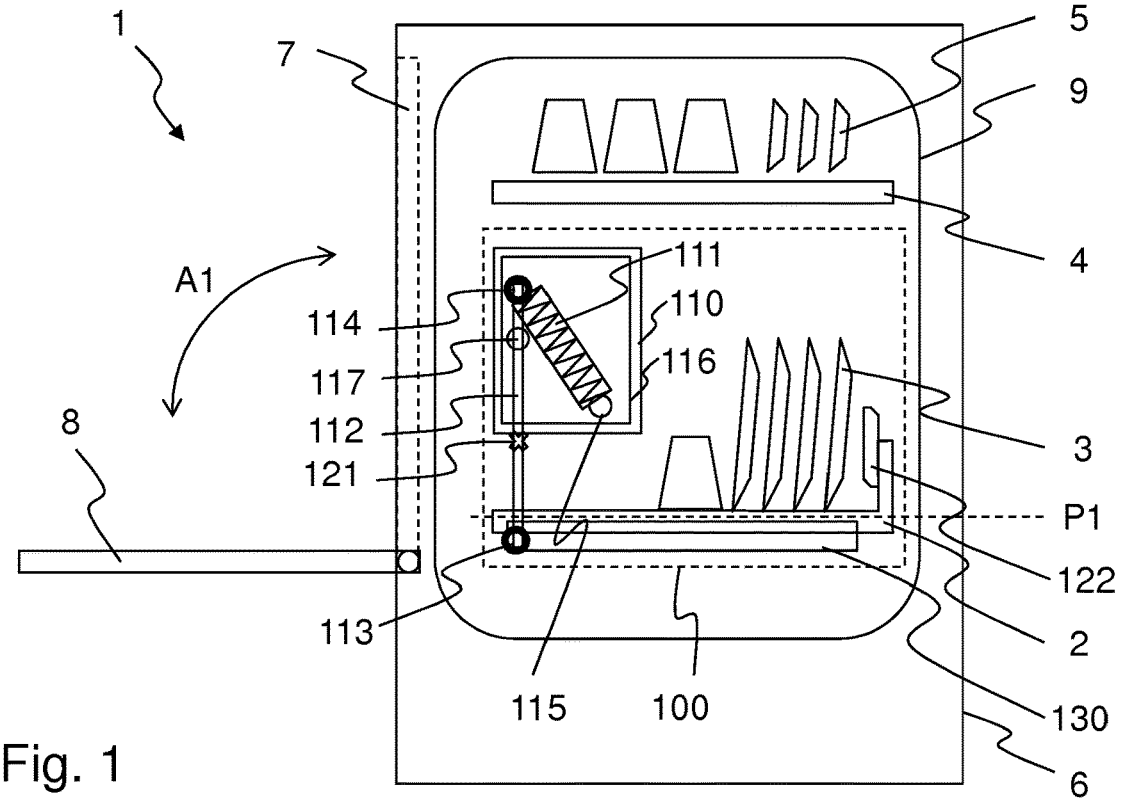
FIG. 1 is a side view illustrating an embodiment of the dishwasher.

Throughout the following description similar reference numerals have been used to denote similar features, such as parts, items, elements, units, protrusions, openings, apertures or the like, when applicable.

FIG. 1 depicts an exemplifying dishwasher 1 according to embodiments herein.

The dishwasher 1 comprises a rack 2, which is conveyable between a displaced position and a start position. The displaced and start positions will be further illustrated with reference to e.g. FIG. 2 and FIG. 5.

The rack 2 has a main extension plane P1, along which the rack 2 is capable of carrying articles 3, such as dinnerware, plates, glasses, bowls, pots, kitchenware or the like. The articles 3 may thus be put at or on the main extension plane P1. The rack 2 may typically be provided with various supporting elements (not shown) for supporting the articles 3.

Additionally, the dishwasher 1 may comprise a further rack 4, which is slidable in and out of the dishwasher 1 according to known manners. The further rack 4 may similarly to the rack 2 carry further articles 5. No further known details of the further rack 4 are provided here for simplicity of description.

Furthermore, the dishwasher 1 comprises a casing 6. The casing 6 is provided with an aperture 7 for allowing the rack 2 and/or the further rack 4 to be conveyed in and out of the dishwasher for on/off loading of the articles 3, 5. The dishwasher 1 further comprises a door 8 hinged at a periphery of the aperture 7, whereby the aperture 7 may be closed or opened A1 by means of the door 8.

Typically, the dishwasher 1 comprises a washtub 9 for housing the rack 2 and/or the further rack 4. During washing of the articles 3, 5 water is injected in to the washtub 9 by means of rotatable arms (not shown) according to known manners.

Moreover, the dishwasher 1 comprises a conveying system 100 for conveying the rack 2 of the dishwasher 1 between the displaced position and the start position along a path. As mentioned above, the displaced and start positions as well as the path will be further illustrated with reference to e.g. FIG. 2. Notably, the rack 2 does not form part of the conveying system 100.

The conveying system 100 comprises an elevating arrangement 110 arranged to bias the rack 2 towards the displaced position.

The conveying system 100 further comprises a locking arrangement 121, 122 arranged to releasably lock the rack 2 in an intermediate position between the displaced position and the start position.

In this manner, the rack 2 is prevented from being biasedly retracted to the displaced position or the rack 2 is prevented from being displaced away from the intermediate position, i.e. displaced towards the start position, due to weight of articles 3 carried by the rack 2.

The conveying system 100 may additionally comprise a rail 130 arranged to convey the rack 2 along the main extension plane P1 of the rack 2.

It may here be noted that the locking arrangement is releasably engagable onto the rack. In this manner, improved user-friendliness may be provided to existing conveying system, should a suitable opening be provided, e.g. drilled, or exist in the elevating arrangement 110, such as in an elevating arm thereof as disclosed below.

In more detail, the elevating arrangement 110 may comprise a biasing member 111, such as a spring, helical spring, gas spring or the like. The biasing member 111 is arranged to bias the rack 2 towards the displaced position.

The elevating arrangement 110 may further comprise an elevating arm 112 pivotably connected, directly or indirectly, to the rail 130 with respect to a rail pivoting point 113. The rail pivoting point 113 moves in relation to the dishwasher 1 as the rack 2 is conveyed between the displaced position and the start position. The elevating arrangement 110 may comprise a further elevating arm (not shown), which also may be pivotably connected to the rail 130. The further elevating arm may facilitate displacement of the rack, while ensuring that the main extension plane P1 of the rack 2 is not titled according to known manners.

A first end of the biasing member 111 is pivotably connected, e.g. with respect to a first pivoting point 114, to the elevating arm 112. The first pivoting point 114 moves in relation to the dishwasher 1 as the rack 2 is conveyed between the displaced position and the start position.

A second end of the biasing member 111 is pivotably connected, e.g. with respect to a second pivoting point 115, to a mounting structure 116 of the elevating arrangement 110. Preferably, the mounting structure 116 is slidable along the main extension plane P1 of the rack 2. However, during displacement of the rack in a direction perpendicular to the main extension plane P1, the second pivoting point 115 does not move relatively the dishwasher 1. In other examples, it may be that the mounting structure 116 may be fixed with respect to the washtub 9, i.e. also with respect to the entire dishwasher 1.

The elevating arm 112 has a longitudinal geometrical axis at which an elevating pivoting point 117 is located. Similarly to the second pivoting point 115, the elevating pivoting point 117 may be slidable along the main extension plane P1 of the rack 2, but during the displacement of the rack in the direction perpendicular to the main extension plane P1 the elevating pivoting point 117 does not move.

In FIG. 1, the biasing member 111 is configured and arranged to provide biasing by means of pulling at the first pivoting point 114. In other examples (not shown), the biasing member 111 may be configured and arranged to provide biasing by means of pushing at a point below the elevating pivoting point 117.

Figure 2:
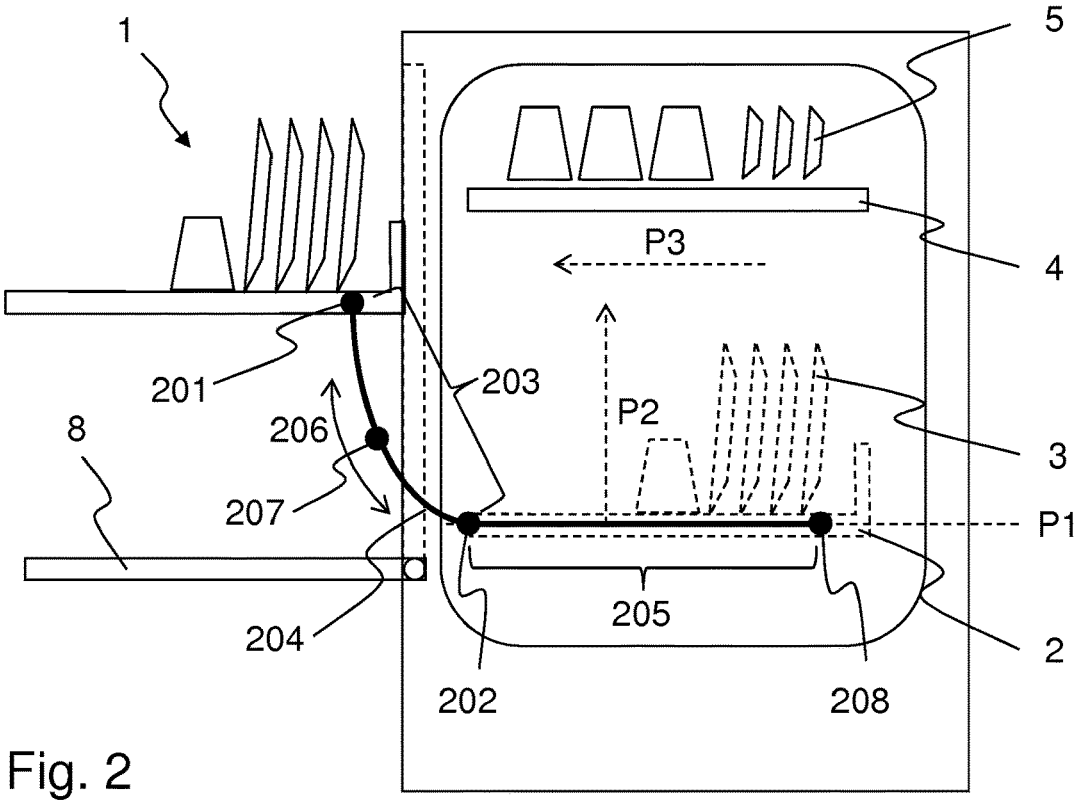
FIG. 2 is another side view illustrating the dishwasher of FIG. 1.

Now turning to FIG. 2, which illustrates the rack 2 of the dishwasher 1 when put, e.g. by a user of the dishwasher 1, in the displaced position, the start position and the intermediate position.

The displaced position 201 is defined by that the rack 2 is displaced with respect to the start position 202 in at least a first direction P2 perpendicular to the main extension plane P1 of the rack 2. The first direction P2 points away from the main extension plane P1 from a side of the rack 2. The side of the rack 2 is adapted to carry the articles 3. When the dishwasher 1 stands in an upright position, which e.g. allows the dishwasher 1 to be operated normally, the first direction P2 points upwards.

The displaced position 201 may be further defined by that the rack 2 is displaced with respect to the start position 202 in a second direction P3 along the main extension plane P1 of the rack 2. With respect to the washtub 9, the second direction P3 points out of the washtub 9. In this manner, the rack 2 is brought further out of the dishwasher when moved from the start position 202 to the displaced position 201.

The start position 202 may be defined by that the rack 2 is freely movable along a portion 203 of the path 204 (indicated by entire bold line) when the locking arrangement 121, 122 does not releasably lock the rack 2 in the intermediate position 207. The movement along the portion 204 of the path 203 may be caused by the user and/or weight of articles 3 and/or biasing achieved by means of the elevating arrangement 110.

The path 203 may optionally comprise a further portion 205.

Returning to the elevating arrangement 110, it may be noted that the elevating arrangement 110 is arranged to bias the rack 2 towards the displaced position when the rack 2 is located at the portion 204 of the path 203. This means that the rack 2 is, as mentioned, freely movable 206 along the portion 204 when rack 2 is not locked in the intermediate position 207. However, the elevating arrangement 110 is still arranged to bias the rack 2 towards the displaced position 201 when the rack 2 is located at the further portion of the path 203, albeit movement due to the biasing is prevented since the elevating arrangement 110 is locked such as to keep the rack 2 along a plane including both the start position and a closed position 208.

Moreover, the elevating arrangement 110 may be configured to lock the rack 2 in the displaced position 201 according to known manners. In this manner, the rack may be prevented from being displaced from the displaced position due to weight of the articles 3 loaded onto the rack 2. When the rack 2 is empty, i.e. not loaded with articles 3 or loaded with few articles 3, the biasing of the elevating arrangement 110 will typically force the rack to the displaced position 201, but as explained above when the user loads articles 3 onto the rack 2 the elevating arrangement 110 may be configured to lock the rack 2 such at to prevent the rack 2 from sinking downwards due to weight of articles 3.

The closed position 208 may be defined by that the dishwasher 1 is operable for washing of articles 3 carried by the rack 2. Typically, the door 8 is closable when the rack 2 is in the closed position 208. In many cases, the dishwasher 1 is configured to only allow operation for washing of at least the articles 3 when the door 8 is closed against the aperture 7.

As an example, the path 204 is at least partly described by a straight line, e.g. drawn between the start position 202 and the closed position 208, wherein the straight line is continued by an arc, e.g. draw between the displaced position 201 and the start position 202. The portion 203 of the path 204 may comprise the arc. The further portion 205 of the path 204 may comprise the straight line. In other examples, the portion 203 and/or the further portion 205 may be shaped differently. For example, the portion 203 may assume a shape of a quarter of an arc, a bent line, a hyperbola, an exponential function or the like. The further portion 205 may assume a shape of a slightly bent line, either upwards or downwards, multiple tiny waves etc. In general, the further portion may assume a shape of a substantially straight line.

The rack 2, when in the displaced position 201, may be located at a first end of the path 204, wherein the portion 203 of the path 204 includes the first end and the arc. The rack 2, when in the start position 202, may be located at a second end of the path 204, wherein the further portion 205 of the path 204 includes the second end and the straight line.

Figure 3:
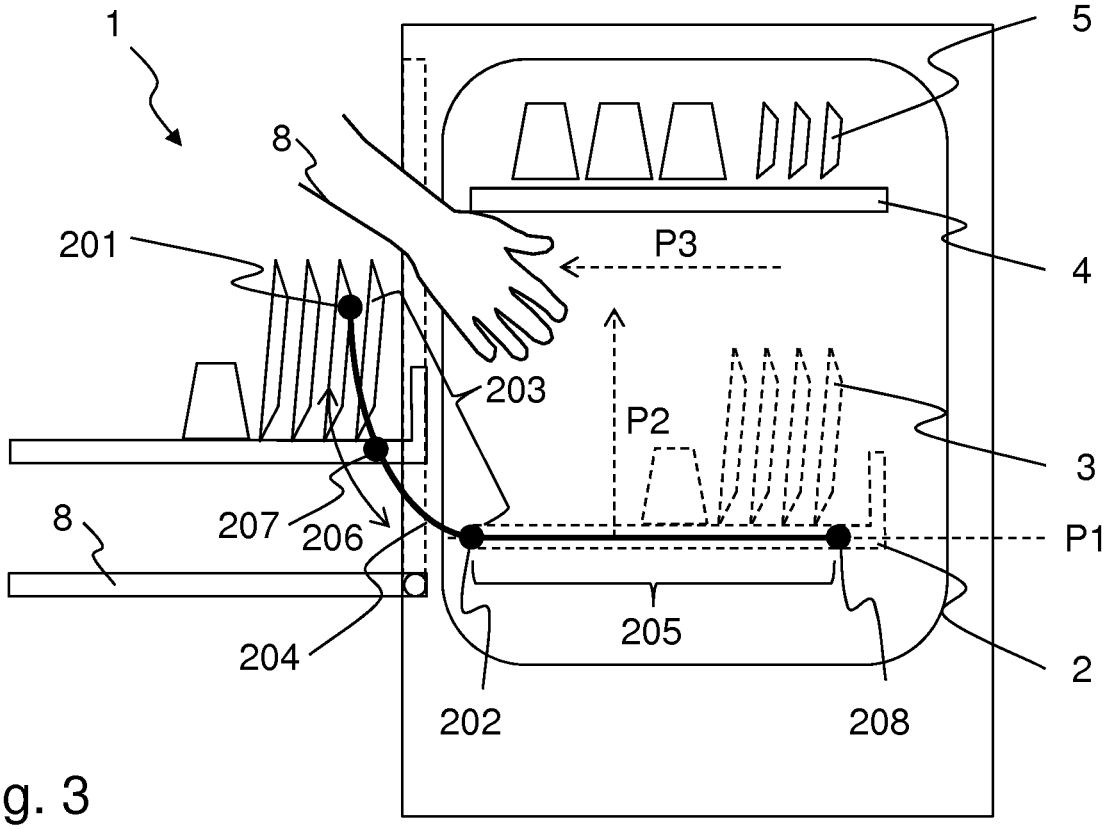
FIG. 3 is a further side view illustrating the dishwasher of FIG. 1.

Now, with reference to FIG. 3, elaborating further on the intermediate position 207, which is located between the displaced position 201 and the start position 202 when the rack 2 is located at the portion 203 of the path 204.

When the rack 2 is located in the intermediate position, user-friendliness of the dishwasher 1 is improved thanks to that access to the interior of the dishwasher 1, such as the washtub 9 is facilitated. The intermediate position 203 allows the interior of the dishwasher 1 to be access via a space between the rack 2 and the further rack 4. Alternatively, if no further rack exists, the space is between the rack 2 and an upper periphery of the aperture 7.

The space may typically be adapted to receive a hand 8 of the user, i.e. the space may typically be large enough for the hand 8 to pass through. Moreover, the space may be large enough to allow e.g. a filter to pass through. The filter is normally removably mounted at a bottom of the washtub 9. The filter prevents food remains and the like from being exhausted out of the washtub as is known in the art. As a further advantage, the space allows the user to easily access e.g. the interior of the dishwasher 1, whereby salt, or other materials/fluids that the dishwasher 1 may make use of, may be refilled for known purposes of treating water, such as decalcification of water.

Figure 4:
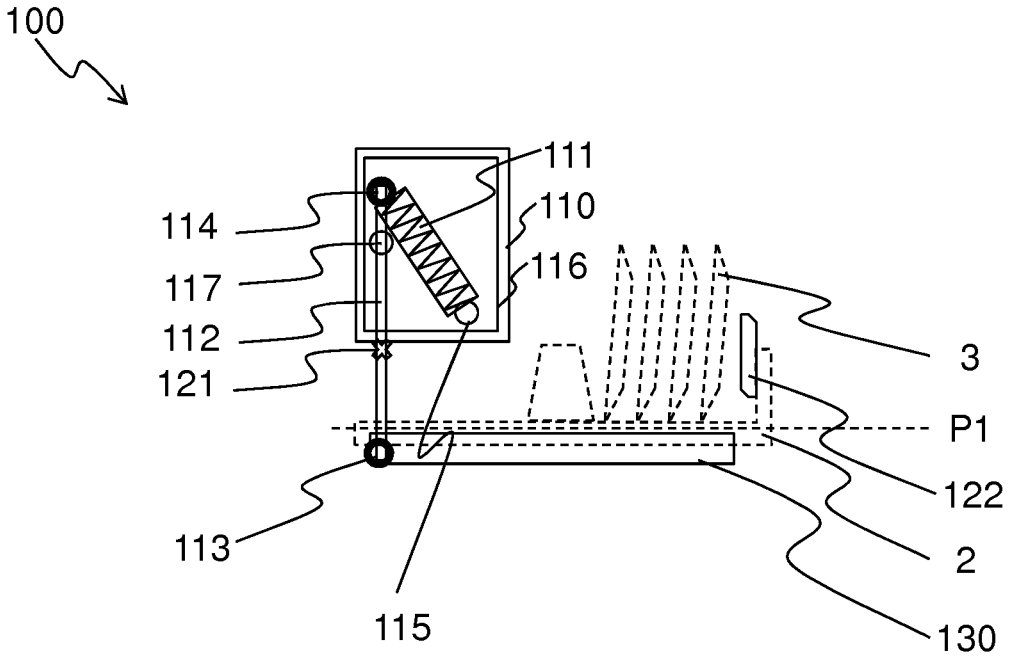
FIG. 4 is a side view illustrating the conveying system of the dishwasher in FIG. 1.

FIG. 4 illustrates an exemplifying conveying arrangement 100 including the locking arrangement 121, 122, which is described in more detail with reference to FIGS. 7 and 8. FIG. 4 illustrates the exemplifying conveying arrangement 100 when the rack 2 is in the closed position 208. In this position, and during extension of the rack 2, in and out of the dishwasher 1, the elevating arrangement 110 assumes a number of locked positions, all being at substantially the same plane as the main extension plane P1 of the rack 2 when conveyed between the closed position and the start position. In the number of locked positions, the elevating arrangement 110 is prevented from biasedly displace the rack 2 towards the displaced position 201, e.g. in order to raise the rack 2 above the main extension plane P1 of the rack 2 when the rack 2 is at the start and/or closed positions 202, 208.

Figure 5:
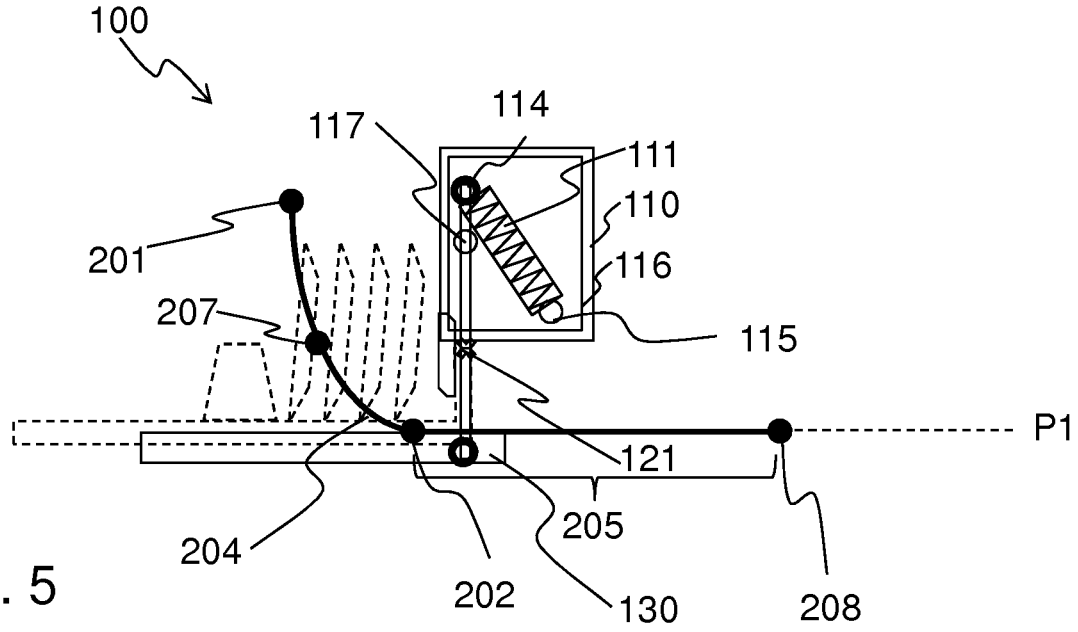
FIG. 5 is another side view illustrating the conveying system.

FIG. 5 illustrates the exemplifying conveying arrangement 100 when the rack 2 is in the start position 202. At the start position 202, the elevating arrangement 220 is no longer prevented from biasedly displace the rack 2 towards the displaced position 201, should the rack 2 be empty or weight of articles 3 thereon so permit.

Figure 6:
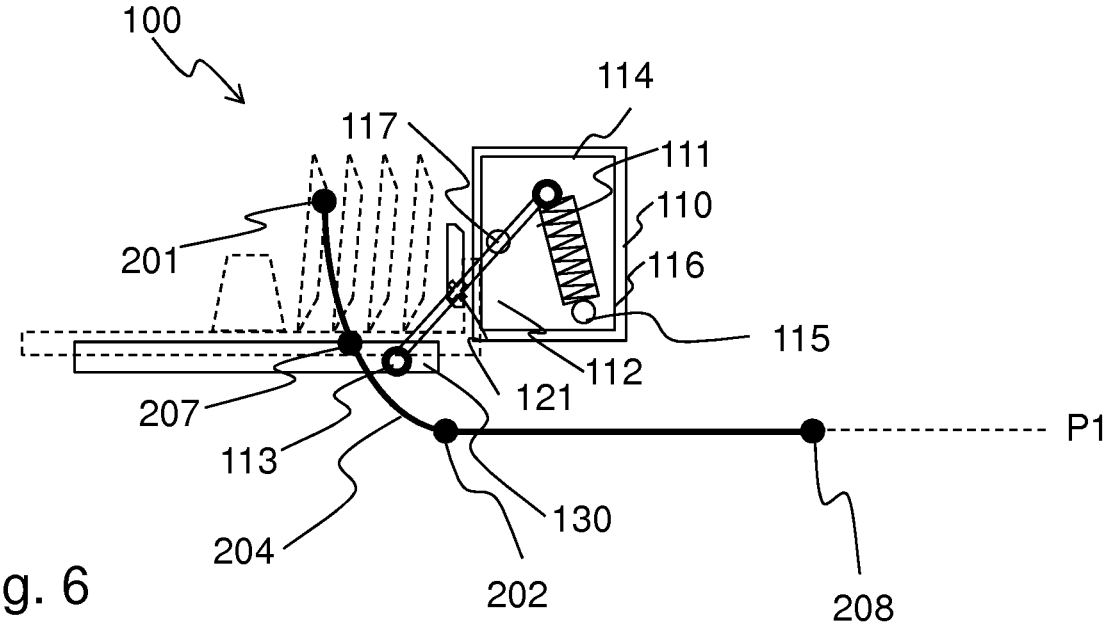
FIG. 6 is a further side view illustrating the conveying system.

FIG. 6 illustrates the exemplifying conveying arrangement 100 when the rack 2 is in the intermediate position 207. Upon reaching the intermediate position 207, the user manually releasably locks the rack 2 in the intermediate position 207. The intermediate position 207 may be reached from the displaced position 201, e.g. due to weight of articles 3 or due to pushing by the user. Furthermore, the intermediate position 207 may be reached from the start position 202 due to biasing provided by the elevating arrangement 110. Notably, in this example the biasing member 111 has been retracted as compared to in FIG. 5.

Figure 7:
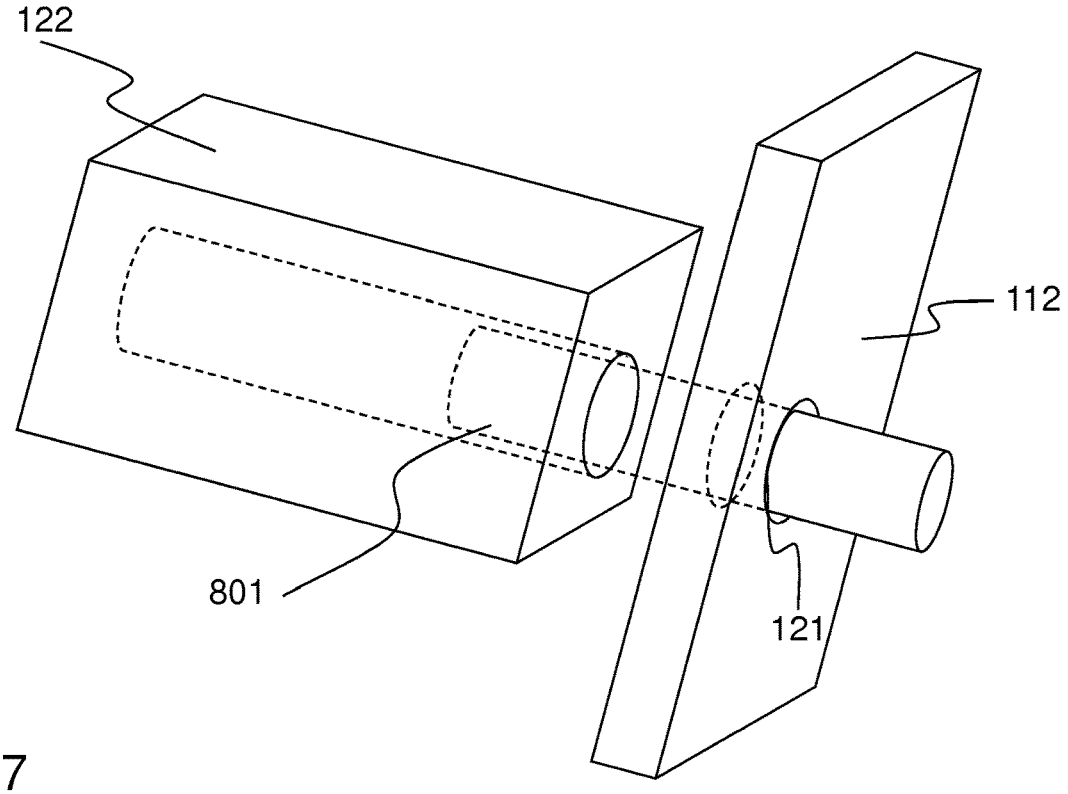
FIG. 7 is a perspective view illustrating an exemplifying locking arrangement of the conveying system.

An exemplifying locking arrangement 121, 122 is illustrated in FIG. 7. The locking arrangement 121, 122 may comprise a protruding element 801 being displaceable between a first location, illustrated in FIG. 7, and a second location, illustrated in FIG. 8.

In this exemplifying embodiment, the elevating arrangement 110, i.e. the elevating arm 112 of the elevating arrangement 110, comprises an opening 121 arranged to receive the protruding element 801. The protruding element 801 and the opening 121 move relatively each other when the rack 2 is conveyed between the displaced position and the start position.

The first location is defined by that the protruding element 801 is displaced to be received by the opening 121 when the rack 2 is in the intermediate position.

Figure 8:
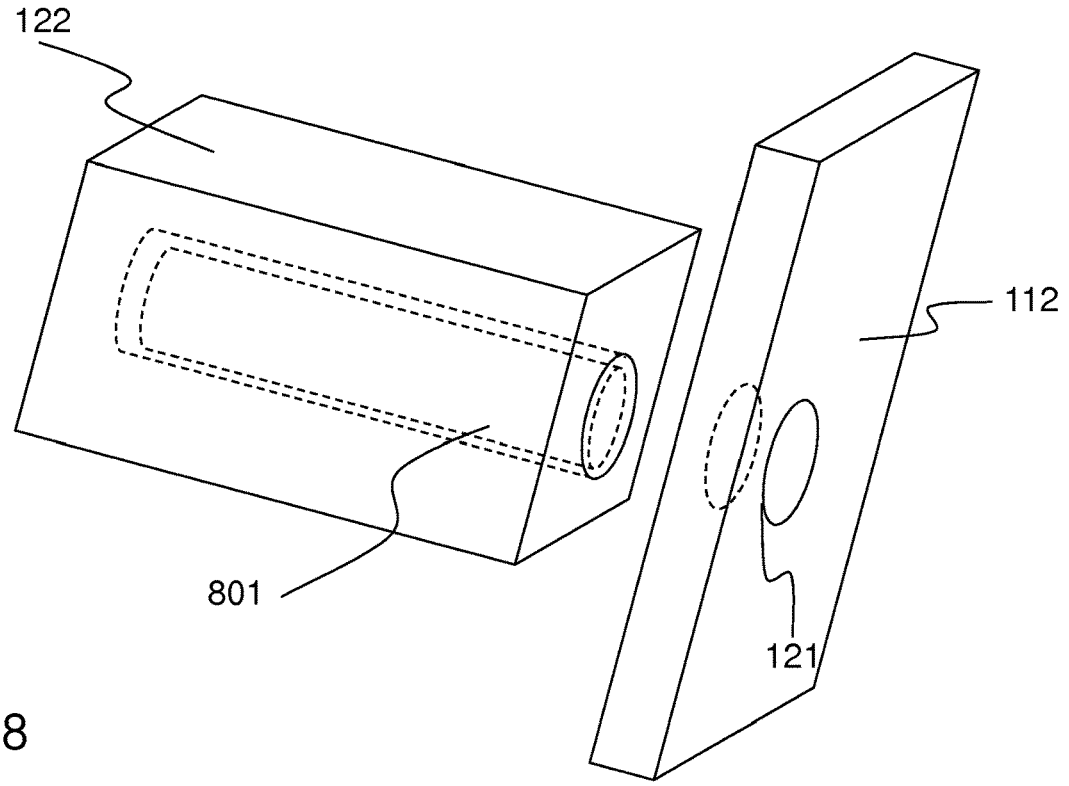
FIG. 8 is another perspective view illustrating the exemplifying locking arrangement.

The second location, as shown in FIG. 8 is defined by that the protruding element 804 is displaced to allow the rack 2 to be freely conveyed, i.e. as determined by biasing, weight of articles or the user, between the displaced position and the start position.

As used herein, the expression "in some embodiments" has been used to indicate that the features of the embodiment described may be combined with any other embodiment disclosed herein.

Further, as used herein, the common abbreviation "e.g.", which derives from the Latin phrase "exempli gratia," may be used to introduce or specify a general example or examples of a previously mentioned item, and is not intended to be limiting of such item.

If used herein, the common abbreviation "i.e.", which derives from the Latin phrase "id est," may be used to specify a particular item from a more general recitation. The common abbreviation "etc.", which derives from the Latin expression "et cetera" meaning "and other things" or "and so on" may have been used herein to indicate that further features, similar to the ones that have just been enumerated, exist.

Even though embodiments of the various aspects have been described, many different alterations, modifications and the like thereof will become apparent for those skilled in the art. The described embodiments are therefore not intended to limit the scope of the present disclosure.

The invention claimed is:

1. A conveying system configured to convey a rack of a dishwasher between a displaced position and a start position along a path, wherein the displaced position is defined by that the rack is displaced with respect to the start position in at least a first direction perpendicular to a main extension plane of the rack, wherein the conveying system comprises:

an elevating arrangement arranged to bias the rack towards the displaced position when the rack is located at a portion of the path; and a locking arrangement arranged to releasably lock the rack in an intermediate position between the displaced position and the start position when the rack is located at the portion of the path, thereby preventing the rack from being biasedly retracted to the displaced position or preventing the rack from being displaced away from the intermediate position due to weight of articles carried by the rack.

2. The conveying system according to claim 1, wherein the path at least partly defines a straight line continued by an arc, wherein the rack, when in the displaced position, is located at a first end of the path, wherein the portion of the path includes the first end and the arc, wherein the rack, when in the start position, is located at a second end of the path, wherein a further portion of the path includes the second end and the straight line.

3. The conveying system according to claim 1, wherein the rack is capable of carrying the articles along the main extension plane.

4. The conveying system according to claim 1, wherein the displaced position is further defined by that the rack is displaced with respect to the start position in a second direction along the main extension plane of the rack.

5. The conveying system according to claim 1, wherein the locking arrangement comprises:

a protruding element being displaceable between a first location and a second location, and wherein the elevating arrangement comprises:

an opening arranged to receive the protruding element, wherein the protruding element and the opening move relative to each other when the rack is conveyed between the displaced position and the start position, wherein the first location is defined by that the protruding element is displaced to be received by the opening when the rack is in the intermediate position, wherein the second location is defined by that the protruding element is displaced to allow the rack to be freely conveyed between the displaced position and the start position.

6. The conveying system according to claim 1, wherein the locking arrangement is releasably engageable onto the rack.

7. A dishwasher comprising a rack, and the conveying system according to claim 1.

8. The dishwasher according to claim 7, wherein the dishwasher comprises a further rack, wherein an interior of the dishwasher is accessible via a space between the rack and the further rack when the rack is in the intermediate position.

9. The dishwasher according to claim 8, wherein the dishwasher further comprises a filter, wherein the space between the rack and the further rack is configured to receive a hand of a user and the filter therethrough for removing the filter from the dishwasher via the space.

10. The dishwasher according to claim 9, wherein in an instance in which the rack is in the displaced position, the rack and the further rack define a spacing that is not configured to receive a hand of a user therethrough.

11. The dishwasher according to claim 7, wherein an interior of the dishwasher is accessible via a space between the rack and the upper periphery of an aperture when the rack is in the intermediate position, and wherein the space between the rack and the further rack is configured to receive a hand of a user therethrough for removing a filter from the dishwasher via the space.

12. The conveying system according to claim 1, wherein the elevating arrangement is further configured to lock the rack in the displaced position.

13. The conveying system according to claim 1, wherein the displaced position comprises a first end of the path.

14. The conveying system according to claim 5, wherein the protruding element is configured to move between the first location and the second location in a direction perpendicular to the path.

15. The conveying system according to claim 14, wherein the opening is configured to follow a second path as the rack moves between the displaced position and the start position, and wherein the direction perpendicular to the path intersects the second path at an intermediate position between two end positions.

16. The conveying system according to claim 14, wherein in an instance in which the protruding element is in the second location, the rack is configured to move freely from the start position to the displaced position without engaging the locking arrangement.

17. The conveying system according to claim 5, wherein in an instance in which the rack is locked in the intermediate position while the protruding element is in the first location, movement of the protruding element from the first location to the second location is configured to cause the locking arrangement to release the rack and permit movement of the rack past the locking arrangement and the intermediate position to the displaced position.

18. The conveying system according to claim 17, wherein the protruding element is configured to move between the first location and the second location in a direction perpendicular to the path.

* * * * *